US010885867B2

(12) United States Patent
Wu et al.

(10) Patent No.: US 10,885,867 B2
(45) Date of Patent: Jan. 5, 2021

(54) DRIVING METHOD FOR DISPLAY DEVICE AND RELATED DRIVING DEVICE

(71) Applicant: Sitronix Technology Corp., Hsinchu County (TW)

(72) Inventors: Kai-Yi Wu, Hsinchu County (TW); Chih-Hung Huang, Hsinchu County (TW)

(73) Assignee: Sitronix Technology Corp., Hsinchu County (TW)

( * ) Notice: Subject to any disclaimer, the term of this patent is extended or adjusted under 35 U.S.C. 154(b) by 0 days.

(21) Appl. No.: 15/413,366

(22) Filed: Jan. 23, 2017

(65) Prior Publication Data

US 2017/0221445 A1 Aug. 3, 2017

Related U.S. Application Data

(60) Provisional application No. 62/289,356, filed on Feb. 1, 2016, provisional application No. 62/339,057, filed on May 19, 2016.

(51) Int. Cl.
*G09G 3/36* (2006.01)

(52) U.S. Cl.
CPC ..... *G09G 3/3696* (2013.01); *G09G 3/3677* (2013.01); *G09G 3/3688* (2013.01); *G09G 2300/043* (2013.01); *G09G 2300/0809* (2013.01); *G09G 2310/08* (2013.01); *G09G 2320/041* (2013.01); *G09G 2360/144* (2013.01)

(58) Field of Classification Search
None
See application file for complete search history.

(56) References Cited

U.S. PATENT DOCUMENTS 6,791,523 B2 9/2004 Fujita
7,256,855 B2 * 8/2007 Baek ..... G02F 1/133514 349/144
8,228,275 B2 * 7/2012 Langendijk ..... G02B 5/201 345/603
8,754,913 B2 * 6/2014 Hwang ..... G02F 1/134336 345/55
9,165,526 B2 * 10/2015 Gu ..... G09G 5/02
(Continued)

FOREIGN PATENT DOCUMENTS

CN 1664901 A 9/2005
CN 102169668 A 8/2011
(Continued)

*Primary Examiner* — Matthew Yeung
(74) *Attorney, Agent, or Firm* — Winston Hsu

(57) ABSTRACT

A driving method for a display device with a plurality of pixels, wherein each pixel includes a plurality of transistors connected in series, includes adjusting a first gate driving signal of a first transistor among the plurality of transistors to make the first transistor cut-off and generating compensation waveform on at least one second gate driving signal of at least one second transistor among the plurality of transistors within a compensation interval of a plurality of intervals between every two contiguous data updating periods among a plurality data updating periods; wherein the plurality of transistors of each pixel are conducted in a specific period within the plurality of data updating periods, to update a data voltage of each pixel.

10 Claims, 7 Drawing Sheets

(56) References Cited

U.S. PATENT DOCUMENTS

| | | | | |
|---|---|---|---|---|
| 2004/0032385 | A1* | 2/2004 | Park | G09G 3/3648 345/95 |
| 2006/0050563 | A1* | 3/2006 | Lee | G09G 3/3648 365/185.22 |
| 2006/0274011 | A1* | 12/2006 | Igarashi | G09G 3/3648 345/94 |
| 2009/0184911 | A1* | 7/2009 | Fukutome | G09G 3/20 345/92 |
| 2011/0170031 | A1 | 7/2011 | Son | |
| 2012/0147060 | A1 | 6/2012 | Jeong | |

FOREIGN PATENT DOCUMENTS

| | | | |
|---|---|---|---|
| CN | 104090441 | A | 10/2014 |
| TW | 201203199 | A1 | 1/2012 |
| TW | 201315284 | A1 | 4/2013 |
| WO | 2004/104981 | A1 | 12/2004 |

* cited by examiner

DRIVING METHOD FOR DISPLAY DEVICE AND RELATED DRIVING DEVICE

CROSS REFERENCE TO RELATED APPLICATIONS

This application claims the benefit of U.S. Provisional Application No. 62/289,356 filed on Feb. 1, 2016 and U.S. Provisional Application No. 62/339,057 filed on May 19, 2016, the contents of which are incorporated herein in their entirety.

BACKGROUND OF THE INVENTION

1. Field of the Invention

The present invention relates to a driving method for a display device and related driving device, and more particularly to a driving method able to mitigate threshold voltage shifting of transistors in the display device and related driving device.

2. Description of the Prior Art

A liquid crystal display (LCD) is a flat panel display which has the advantages of low radiation, light weight and low power consumption and is widely used in various information technology (IT) products, such as notebook computers, personal digital assistants (PDA), and mobile phones. An active matrix thin film transistor (TFT) LCD is the most commonly used transistor type in LCD families, and particularly in the large-size LCD family. A driving system installed in the LCD includes a timing controller, source drivers and gate drivers. The source and gate drivers respectively control data lines and scan lines, which intersect to form a cell matrix. Each intersection is a cell including crystal display molecules and a TFT. In the driving system, the gate drivers are responsible for transmitting scan signals to gates of the TFTs to turn on the TFTs on the panel. The source drivers are responsible for converting digital image data, sent by the timing controller, into analog voltage signals and outputting the voltage signals to sources of the TFTs. When a TFT receives the voltage signals, a corresponding liquid crystal molecule has a terminal whose voltage changes to equalize the drain voltage of the TFT, which thereby changes its own twist angle. The rate that light penetrates the liquid crystal molecule is changed accordingly, allowing different colors to be displayed on the panel. In the prior art, the U.S. Pat. No. 8,477,092 and the U.S. Pat. No. 8,248,341 provide different methods of driving the LCD.

In order to reduce the power consumption of the LCD, the driving system of the LCD may dynamically reduce a refreshing rate. Under such a condition, a display quality of the LCD would not be affected and the power consumption of refreshing frames can be saved. When the refreshing rate of the LCD is reduced to ultra-low frequency (e.g. 1 Hz), the gate of the TFT in each cell of the LCD receives negative gate voltage for a long period of time, resulting that the threshold voltage of the TFT in each cell gradually decreases and the LCD may work abnormally. Thus, how to mitigate the shifting of the threshold voltage of the TFT becomes a topic to be discussed.

SUMMARY OF THE INVENTION

In order to solve the above issue, the present invention provides a driving method able to mitigate shifting of threshold voltage shifting of transistors in the display device and related driving device.

In an aspect, the present invention discloses a driving method for a display device with a plurality of pixels, wherein each pixel includes a plurality of transistors connected in series. The driving method comprises adjusting a first gate driving signal of a first transistor among the plurality of transistors to make the first transistor cut-off and generating compensation waveform on at least one second gate driving signal of at least one second transistor among the plurality of transistors within a compensation interval of a plurality of intervals between every two contiguous data updating periods among a plurality data updating periods; wherein the plurality of transistors of each pixel are conducted in a specific period within the plurality of data updating periods, to update a data voltage of each pixel.

In another aspect, the present invention discloses a driving device, for a display device with a plurality of pixels, wherein each pixel comprises a plurality of transistors connected in series. The driving device comprises a driving module, for generating a plurality of gate driving signals controlling the plurality of transistors in each pixel according to a control signal; and a control module, for adjusting a first gate driving signal of a first transistor among the plurality of transistors to make the first transistor cut-off and generating compensation waveform on at least one second gate driving signal of at least one second transistor among the plurality of transistors within a compensation interval of a plurality of intervals between every two contiguous data updating periods among a plurality data updating periods; wherein the plurality of transistors of each pixel are conducted in a specific period within the plurality data updating periods, to update a data voltage of each pixel.

In still another aspect, the present invention discloses a driving method for a display device with a plurality of pixels, wherein each pixel includes a plurality of transistors connected in series. The driving method comprises adjusting at least one first gate driving signal of at least one first transistor among the plurality of transistors to make the at least one first transistor cut-off and generating compensation waveform on at least one second gate driving signal of at least one second transistor among the plurality of transistors within a compensation interval of a plurality of intervals between every two contiguous data updating periods among a plurality data updating periods; wherein the plurality of transistors of each pixel are conducted in a specific period within the plurality of data updating periods, to update a data voltage of each pixel.

In yet another aspect, the present invention discloses a driving device, for a display device with a plurality of pixels, wherein each pixel comprises a plurality of transistors connected in series. The driving device comprises a driving module, for generating a plurality of gate driving signals controlling the plurality of transistors in each pixel according to a control signal; and a control module, for adjusting at least one first gate driving signal of at least one first transistor among the plurality of transistors to make the at least one first transistor cut-off and generating compensation waveform on at least one second gate driving signal of at least one second transistor among the plurality of transistors within a compensation interval of a plurality of intervals between every two contiguous data updating periods among a plurality data updating periods; wherein the plurality of transistors of each pixel are conducted in a specific period within the plurality of data updating periods, to update a data voltage of each pixel.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
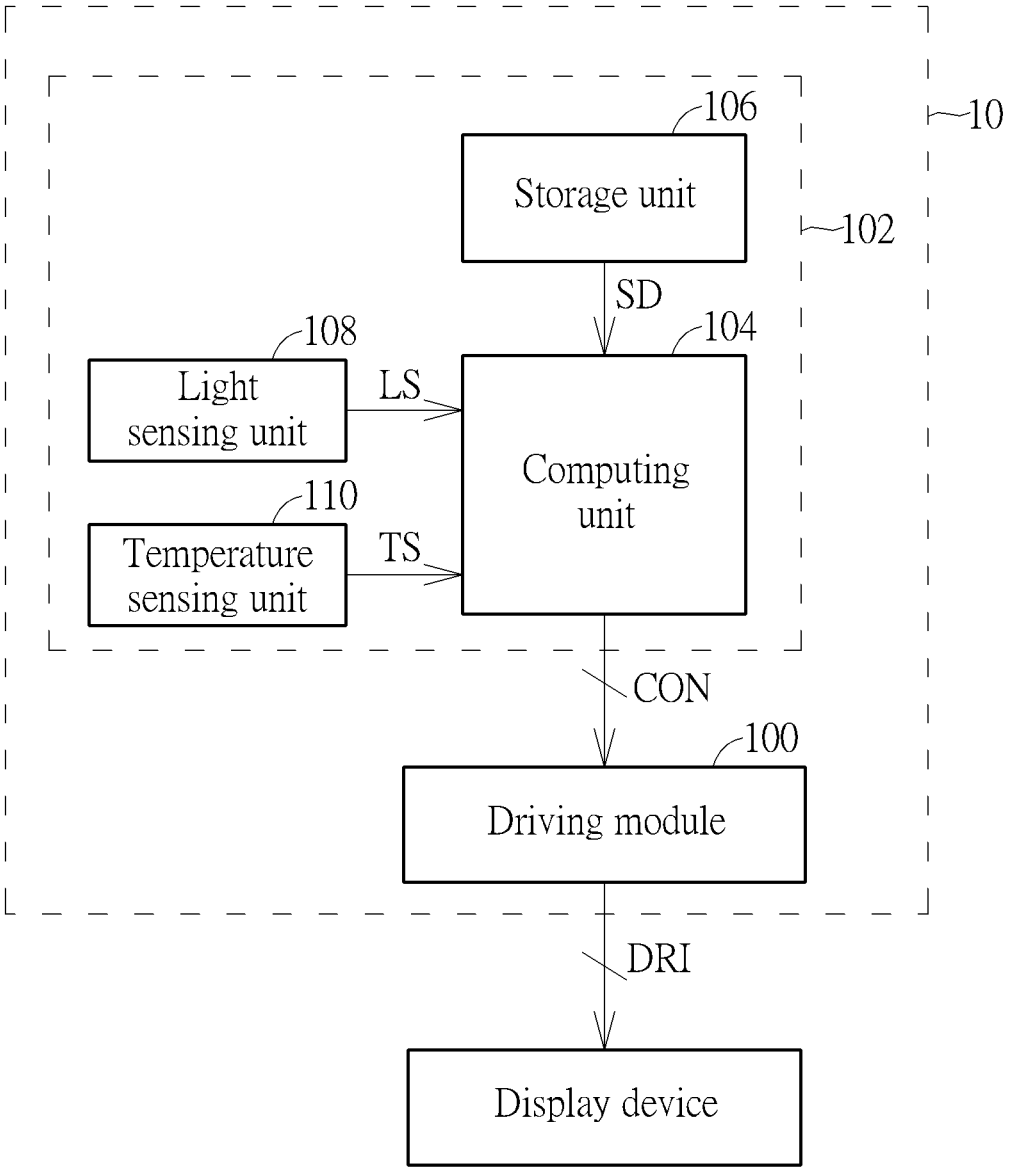
FIG. 1 is a schematic diagram of a driving device according to an example of the present invention.

Please refer to FIG. 1, which is a schematic diagram of a driving device 10 according to an example of the present invention. The driving device 10 may be a driver integrated circuit (IC) and is utilized to generate driving signals DRI of driving a display device. For example, the display device may be an electronic product with a display panel, such as a smart phone, a tablet, or a laptop, and is not limited herein. As shown in FIG. 1, the driving device 10 comprises a driving module 100 and a control module 102. The driving module 100 is utilized to adjust the driving signals DRI according to a control signal CON generated by the control module 102. In an example, the driving signals DRI comprises gate driving signals of controlling transistors in each pixel unit of the display device and source driving signals of adjusting data voltages of the pixel units of the display device. In order to prevent threshold voltages of the transistors connected in series in the pixel units from deviating from designed values, the control module 102 makes at least one first transistor of the transistors connected in series cut-off and adjusts the gate driving signal of at least one second transistor among the transistors connected in series within an interval between two contiguous data updating periods. Under such a condition, the gates of the transistors in the pixel units avoid receiving the voltage of fixed polarity for a long period of time. The shifting of the threshold voltages of the transistors can be mitigated, therefore.

As shown in FIG. 1, the control module 102 comprises a computing unit 104, a storage unit 106, a light sensing unit 108 and a temperature sensing unit 110. The computing unit 104 is utilized to generate the control signal CON of controlling the driving module 100. According to setting data SD stored in the storage unit 106, the computing unit 104 controls the driving module 100 to make the at least one first transistor of the series transistors cut-off and to generate a compensation waveform on the gate driving signal of the at least one second transistor of the transistors connected in series within random interval between data updating periods, to mitigate the shifting of the threshold voltages of the transistors. That is, at least one transistor of the transistor connected in series in each pixel unit is cut-off within single interval between the data updating periods. Thus, the data voltage of each pixel unit would not be affected and the image displayed by the display device does not blink.

Because the threshold voltage shifting of the transistors correlates with light and temperature, the control module 102 utilizes the light sensing unit 108 and the temperature sensing unit 110 to sense the ambient light and temperature and to accordingly generate a light sensing signal LS and a temperature sensing signal TS as the references of controlling the driving module 100 to make the at least one first transistor cut-off and to generate the compensation waveform on the gate driving signal of the at least one second transistor within random interval between the data updating periods. Note that, the light sensing unit 108 and the temperature sensing unit 110 may be independent external components and may not be configured in the driving device 10.

Figure 2:
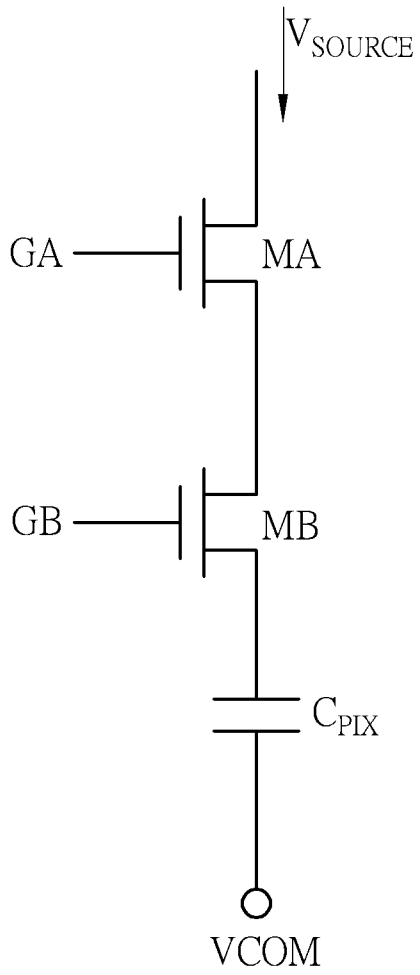
FIG. 2 is a simplified circuit diagram of a pixel unit in a display device according to an example of the present invention.

As to details of the control module 102 controlling the driving module 100 to control the transistors in the pixel units within the intervals between the data updating periods please refer to the followings. Please refer to FIG. 2, which is a simplified circuit diagram of a pixel unit PIX in the display device according to an example of the present invention. As shown in FIG. 2, the pixel unit PIX comprises transistors MA and MB connected in series, and a capacitor $C_{PIX}$, wherein one end of the capacitor $C_{PIX}$ is coupled to the source of the transistor MB and another end of the capacitor $C_{PIX}$ is coupled to a common voltage VCOM. Based on gate driving signals GA and GB, the transistors MA and MB output a corresponded driving signal $V_{SOURCE}$ to the capacitor $C_{PIX}$, to change a data voltage of the capacitor $C_{PIX}$. In the example shown in FIG. 2, the driving signals DRI at least comprises the gate driving signals GA and GB, and the source driving signal $V_{SOURCE}$ of each pixel unit PIX. According to different applications and designed concepts, the pixel unit PIX may comprises more than 2 transistors that are connected in series.

When the display device operates, the gate driving signals GA and GB are increased to a gate high voltage $V_{GH}$ in the data updating periods of updating the data voltage on the capacitors $C_{PIX}$ to conduct the transistors MA and MB and are kept at a gate low voltage $V_{GL}$ outside the data updating periods to make the transistors MA and MB cut-off. The computing unit 104 controls the control module 100, via the control signal CON, to make one of the transistors MA and MB cut-off and to output the compensation waveform to another one of the transistors MA and MB in the interval between the data updating periods of updating the data voltage of capacitor $C_{PIX}$, to prevent the transistors MA and MB from receiving the gate low voltage VGL for a long period of time. In an example, the compensation waveform is a square wave whose maximum voltage is $V_{GM}$ that is greater than the minimum voltage of the display device (e.g. greater than the gate low voltage $V_{GL}$). Because the gates of the transistors MA and MB avoid receiving the gate low voltage $V_{GL}$ indicating the cut-off state for a long period of time, the threshold voltage shifting can be mitigated. In addition, the data voltage of the capacitor $C_{PIX}$ is approximately unchanged because the driving module 100 makes one of the transistors MA and MB cut-off in the interval. Thus, the image displayed by the display device does not blink when adopting the abovementioned method to prevent the threshold voltages of the transistors MA and MB in the pixel unit PIX from deviating from the designed values.

Figure 3:
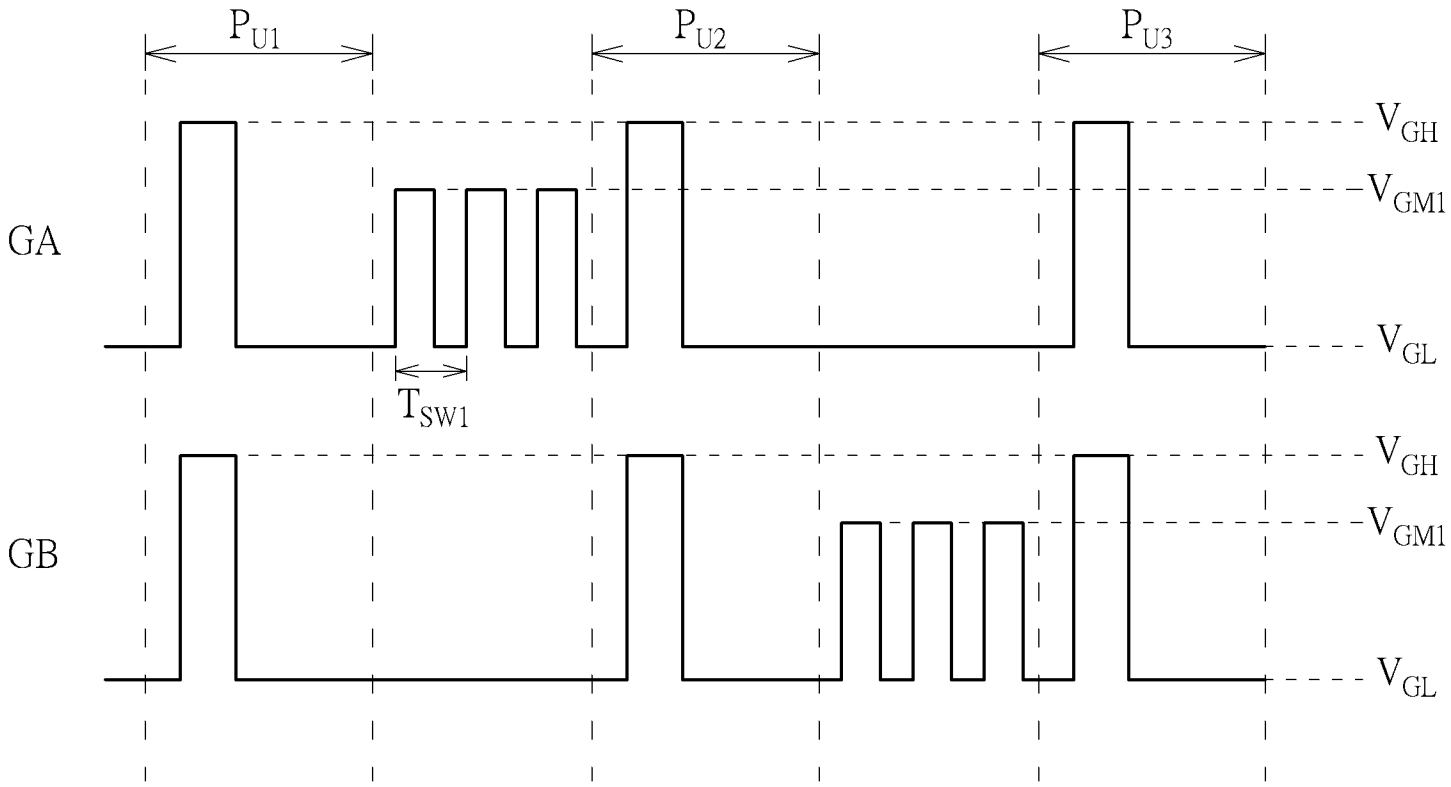
FIG. 3 is a time diagram of related signals in the pixel unit shown in FIG. 2.

Please refer to FIG. 3, which is a schematic diagram of related signals of the pixel unit PIX shown in FIG. 2. As shown in FIG. 3, the gate driving signals GA and GB switch from the gate low voltage $V_{GL}$ to the gate high voltage $V_{GH}$ within a specific period in each of data updating periods $P_{U1}$-$P_{U3}$, to conduct the transistors MA and MB and to allow the source driving signal $V_{SOURCE}$ to change the data voltage of the capacitor $C_{PIX}$. After the data voltage is updated in the specific period, the gate driving signals GA and GB switches back to the gate low voltage $V_{GL}$, to make the transistors MA and MB cut-off and to keep the data voltage of the capacitor $C_{PIX}$ unchanged. Generally speaking, the gate driving signals GA and GB switches to the gate high voltage $V_{GH}$ only in the specific periods of the data updating periods $P_{U1}$-$P_{U3}$ and are kept at the gate low voltage $V_{GL}$ at rest of times. Since the gates of the transistors MA and MB receives the gate low voltage $V_{GL}$ for a long period of time, the threshold voltages of the transistors MA and MB would be shifted, resulting that the transistors MA and MB may not be able to enter the cut-off state.

Thus, the computing unit 104 controls the driving module 100 generate a square wave (i.e. the compensation waveform), whose period is $T_{SW1}$ and the maximum voltage is $V_{GM1}$, on the gate driving signal GA within the interval between the data updating periods $P_{U1}$ and $P_{U2}$ in the example shown in FIG. 3, to prevent the threshold voltage of the transistor MA from shifting. Note that, the gate driving signal GB is kept at the gate low voltage $V_{GL}$ in the interval between the data updating periods $P_{U1}$ and $P_{U2}$, to make the transistor MB cut-off. Since the transistor MB is cut-off in the interval between the data updating periods $P_{U1}$ and $P_{U2}$, the data voltage of the capacitor $C_{PIX}$ remains unchanged. In FIG. 3, the square wave whose period is $T_{SW1}$ goes through multiple periods and the gate driving signal GA switches to the voltage $V_{GM1}$ multiple times within the interval between the data updating periods $P_{U1}$ and $P_{U2}$. In this example, the voltage $V_{GM1}$ is able to conduct the transistors MA and MB.

Similarly, the square wave, whose period is $T_{SW1}$ and the maximum voltage is $VG_{M1}$, is generated on the gate driving signal GB within an interval between the data updating periods $P_{U2}$ and $P_{U3}$, to prevent the threshold voltage of the transistor MB from shifting. Within the interval between the data updating periods $P_{U2}$ and $P_{U3}$, the gate driving signal GA is kept at the gate low voltage $V_{GL}$. Since the transistor MA is cut-off within the interval between the data updating periods $PU_2$ and $P_{U3}$, the data voltage of the capacitor $Cp_{PIX}$ remains the same.

As can be seen from FIG. 3, the example of the present invention makes one of the transistors MA and MB cut-off within single interval. Under such a condition, the data voltage of the capacitor $C_{PIX}$ would not be reduced by multiple times of charge sharing with external circuits. The image displayed by the display device does not blink because the data voltages do not vary.

Figure 4:
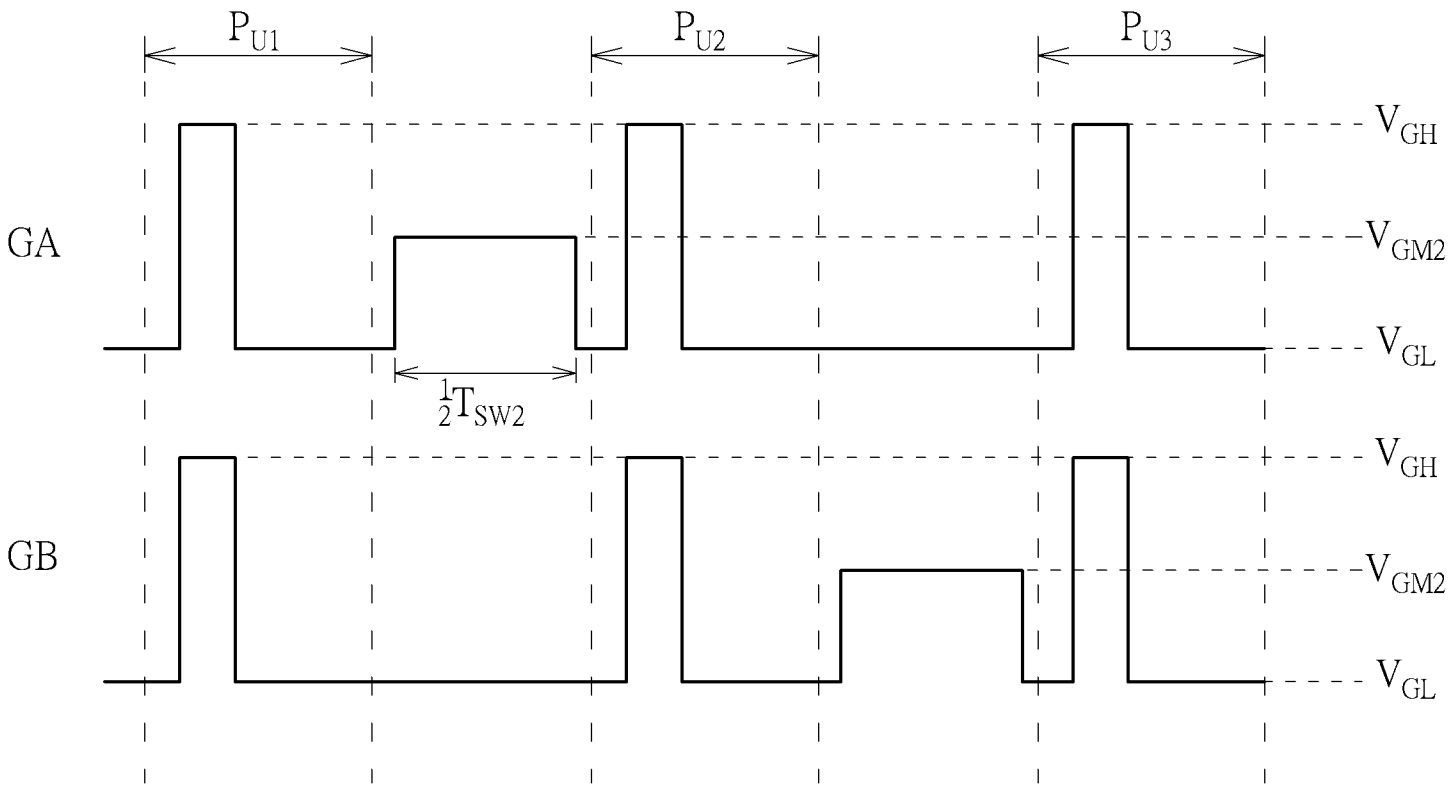
FIG. 4 is a time diagram of related signals in the pixel unit shown in FIG. 2.

Please refer to FIG. 4, which is a schematic diagram of related signals of the pixel unit PIX shown in FIG. 2. As shown in FIG. 4, the gate driving signals GA and GB switch from the gate low voltage $V_{GL}$ to the gate high voltage $V_{GH}$ within a specific period in each of data updating periods $P_{U1}$-$P_{U3}$, to conduct the transistors MA and MB and to allow the source driving signal $V_{SOURCE}$ to change the data voltage of the capacitor $C_{PIX}$. After the data voltage is updated in the specific period, the gate driving signals GA and GB switches back to the gate low voltage $V_{GL}$, to make the transistors MA and MB cut-off and to keep the data voltage of the capacitor $C_{PIX}$ unchanged.

In the example shown in FIG. 4, a square wave, whose period is $T_{SW2}$ and the maximum voltage is $V_{GM2}$, is generated on the gate driving signal GA within the interval between the data updating periods $P_{U1}$ and $P_{U2}$. In comparison with the compensation waveform shown in FIG. 3, the compensation waveform shown in FIG. 4 only switches to the image $V_{GM2}$ once and the time of the compensation wave form shown in FIG. 4 is kept at the voltage $V_{GM2}$ approximates the period of the interval between the data updating periods $P_{U1}$ and $P_{U2}$. That is, the half of period $T_{SW2}$ ($0.5*T_{SW2}$) approximates the period of the interval between the data updating periods $P_{U1}$ and $P_{U2}$. The gate driving signal GB is kept at the gate low voltage $V_{GL}$ within the interval between the data updating periods $P_{U1}$ and $P_{U2}$, to make the transistor MB cut-off. The data voltage of the capacitor $C_{PIX}$ remains the same, therefore.

Next, the square wave, whose period is $T_{SW2}$ and the maximum voltage is $V_{GM2}$, is generated on the gate driving signal GB within the interval between the data updating periods $P_{U2}$ and $P_{U3}$, to prevent the threshold voltage of the transistor MB from shifting. Within the interval between the data updating periods $P_{U2}$ and $P_{U3}$, the gate driving signal GA is kept at the gate low voltage $V_{GL}$. Since the transistor MA is cut-off within the interval between the data updating periods PU2 and PU3, the data voltage of the capacitor CPIX remains unchanged.

Note that, the compensation waveform shown in FIG. 3 switches to the voltage $V_{GM1}$ multiple times and is similar to an alternating current (AC) signal and the compensation waveform shown in FIG. 4 switches to the voltage $V_{GM2}$ only one time and is similar to a direct current (DC) signal. Thus, the compensation waveform shown in FIG. 4 consumes less power on transitions. According to different applications and designed concepts, the compensation waveform may be realized by various methods and is not limited to those shown in FIGS. 3 and 4.

In an example, the computing unit 104 adjusts the frequency of generating the compensation waveform during the period of multiple data updating periods. For example, the computing unit 104 may controls the driving module 100 to generate the compensation waveform on the gate driving signal GA or GB in one of multiple contiguous intervals between every two contiguous data updating periods. Please refer to FIG. 5, which is a schematic diagram of related signals of the pixel unit PIX shown in FIG. 2 and shows 5 contiguous data updating periods $P_{U1}$-$P_{U5}$. In this example, the computing unit 104 keeps the gate driving signal GB at the gate low voltage $V_{GL}$ and generates the compensation waveform on the gate driving signal GA within the interval between the data updating periods $P_{U1}$ and $P_{U2}$. In addition, the computing unit 104 keeps the gate driving signal GA at the gate low voltage $V_{GL}$ and generates the compensation waveform on the gate driving signal GB within the interval between the data updating periods $P_{U4}$ and $P_{U5}$. As can be seen from FIG. 5, the computing unit 104 makes one of the transistors MA and MB cut-off and outputs the compensation waveform to another one of the transistors MA and MB in one of 4 contiguous intervals. In comparison with the signals shown in FIG. 3, the frequency of generating the compensation waveform is reduced. The power consumption of avoiding the threshold voltages of the transistors in each pixel unit PIX shifting is decreased, therefore.

Figure 5:
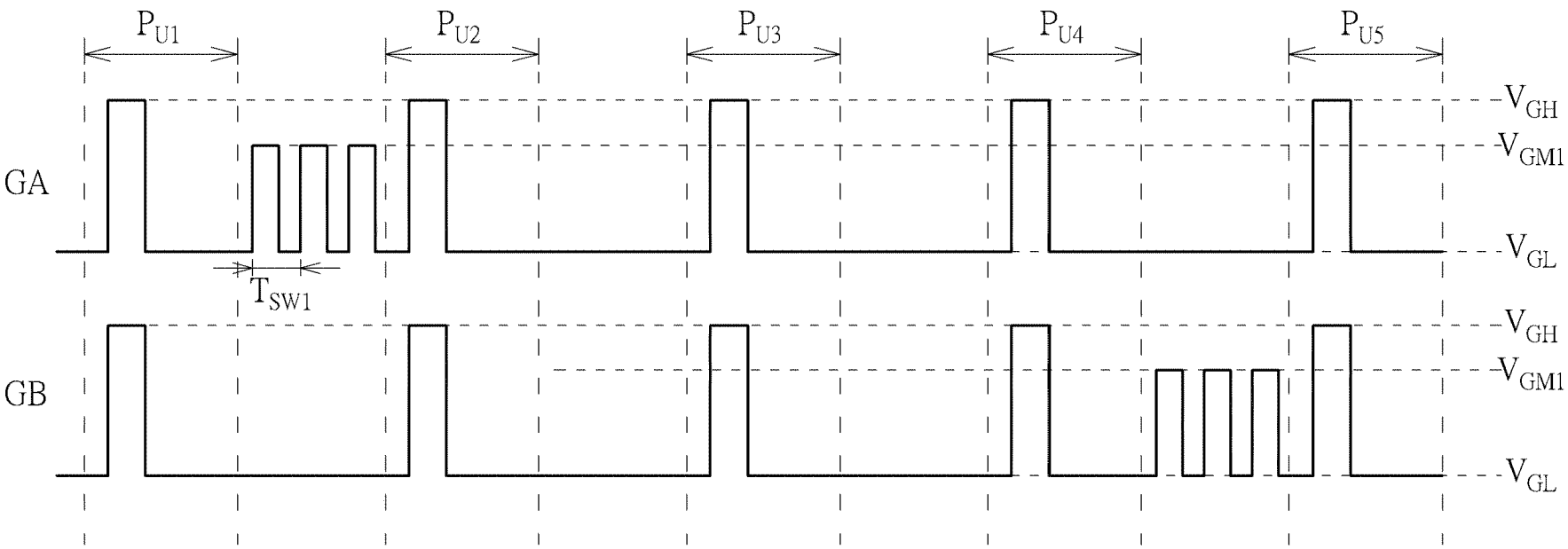
FIG. 5 is a time diagram of related signals in the pixel unit shown in FIG. 2.

Note that, the compensation waveform shown in FIG. 5 is similar to that shown in FIG. 3. According to different applications and designed concepts, the compensation waveform shown in FIG. 5 may be changed to be that shown in FIG. 4.

The compensation waveform on the gate driving signals GA and GB within the interval between the data updating periods may be appropriately altered. For example, the voltages $V_{GM1}$ and $V_{GM2}$ can be altered according to physical features of the display device as long as the voltages $V_{GM1}$ and $V_{GM2}$ are greater than the gate low voltage $V_{GL}$.

In addition, the periods $T_{SW1}$ and $T_{SW2}$ may be appropriately changed when the compensation waveform shown in FIGS. 3 and 4 are used to prevent the threshold voltages of the transistors MA and MB from shifting. In an example, the period $T_{SW1}$ of the square wave shown in FIG. 3 is reduced to increase the number of square pulses included in single interval. In another example, the period $T_{SW2}$ of the square wave shown in FIG. 4 is increased to increase the time of the gate driving signals GA and GB being kept at the voltage $V_{GM2}$ in single interval. In the example of the present invention, the designer is able to change the setting data SD stored in the storage unit 106 to alter the compensation waveform. The performance of the display device can be optimized according to the physical features of the display device, therefore.

Note that, the threshold voltage shifting of the transistors MA and MB is affected by the light and the temperature. Thus, the computing unit 104 receives the light sensing signals LS and the temperature sensing signal TS related to the ambient environment conditions and accordingly determines whether to output the compensation waveform within the intervals among the data updating periods. In an example, because the threshold voltage of the transistors MA and MB shifts more seriously when the transistors MA and MB receive external light, the computing unit 104 generates the corresponded control signal CON to adjust the waveform of the gate driving signals GA and GB and to prevent the threshold voltages of the transistors MA and MB from deviating when determining light flux indicated by the light sensing signal LS exceeds a illumination threshold. In another example, because the threshold voltage of the transistors MA and MB shifts more seriously when the ambient temperature is higher, the computing unit 104 generates the corresponded control signal CON to adjust the waveform of the gate driving signals GA and GB and to prevent the threshold voltages of the transistors MA and MB from deviating when determining the temperature indicated by the temperature sensing signal TS exceeds a high temperature threshold.

Figure 6:
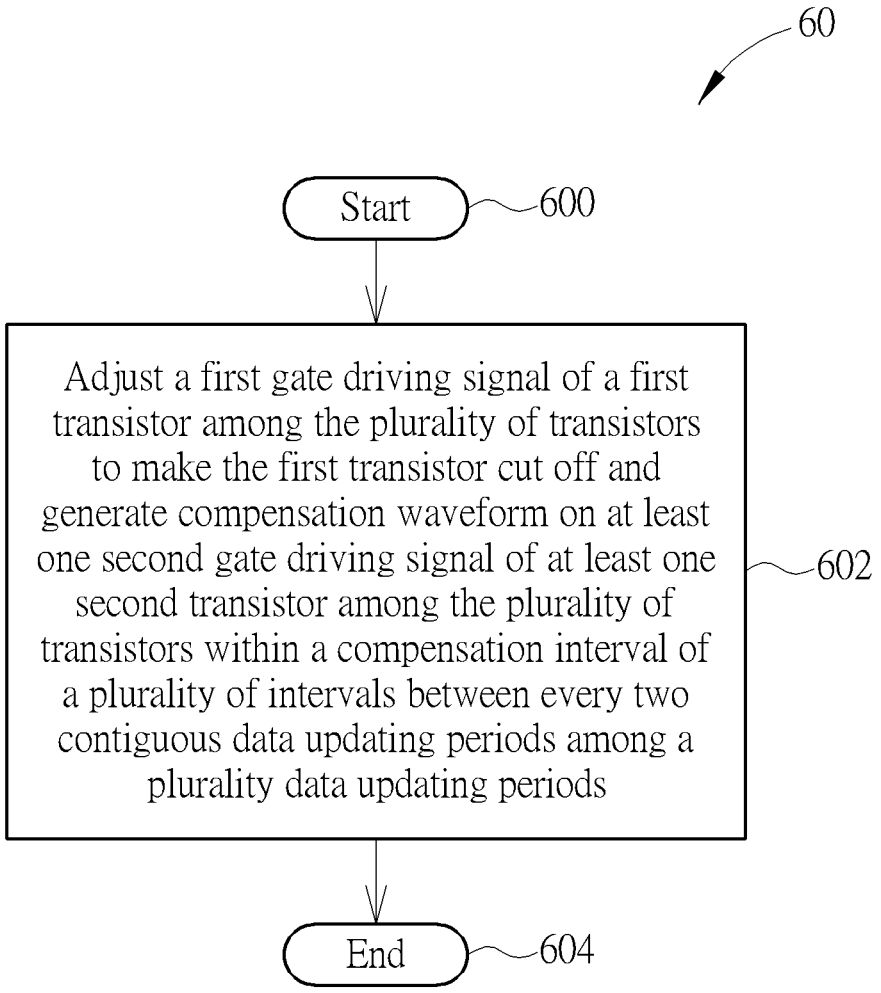
FIG. 6 is a flowchart of a process according to an example of the present invention.

The method of the computing unit outputting the compensation waveform to mitigate the threshold voltage shifting of the transistors in the pixel unit can be summarized into a process 60 shown in FIG. 6. The process 60 can be utilized in a driving device of a display device to preventing threshold voltages of a plurality of transistors connected in series (i.e. a plurality of series transistors) in each pixel unit of the display device from shifting. The process 60 comprises the following steps:

Step 600: Start.

Step 602: Adjust at least one first gate driving signal of at least one first transistor among the plurality of transistors to make the at least one first transistor cut-off and generate compensation waveform on at least one second gate driving signal of at least one second transistor among the plurality of transistors within a compensation interval of a plurality of intervals between every two contiguous data updating periods among a plurality of data updating periods.

Step 604: End.

According to the process 60, the driving device adjusts at least one first gate driving signal of at least one first transistor among the plurality of transistors to make the first transistor cut-off within a compensation interval among a plurality of intervals between every two contiguous data updating periods among a plurality of data updating periods. For example, the driving device may adjust the at least one first gate driving signal to the minimum voltage of the display device to make the at least one first transistor cut-off. Within the compensation interval, the driving device generates compensation waveform on at least one second gate driving signal of at least one second transistor among the plurality of transistors. Because the at least one first transistor is cut-off within the compensation interval, the data voltage of each pixel unit is kept unchanged. The image displayed by the display device does not blink, therefore.

As to detailed operations of the process 60 please refer to the followings. In an example, each pixel unit in the display device comprises 3 series transistors M1-M3, wherein the transistor M1 is coupled to a data line, the transistor M3 is coupled to liquid crystal component of the pixel unit, and the transistor M2 is coupled between the transistors M1 and M3. In an example, the driving device adjusts the gate driving signal of the transistor M1 to make the transistor M1 cut-off and generates the compensation waveform on at least one of the gate driving signals of the transistors M2 and M3 in a compensation interval, to prevent the threshold voltage of at least one of the transistors M2 and M3 from shifting. In another compensation interval, the driving device adjusts the gate driving signal of the transistor M2 to make the transistor M2 cut-off and generates the compensation waveform on at least one of the gate driving signals of the transistors M1 and M3 in a compensation interval, and so on. In this example, because at least one of the transistors M1-M3 is cut-off in each compensation interval, the data voltage of each pixel unit is kept unchanged. The image displayed by the display device does not blink, therefore.

In another example, the driving device adjusts the gate driving signals of the transistors M1 and M2 to make the transistors M1 and M2 cut-off and generates the compensation waveform on the gate driving signals of the transistor M3 in a compensation interval, to prevent the threshold voltage of the transistor M3 from shifting. In another compensation interval, the driving device adjusts the gate driving signals of the transistors M2 and M3 to make the transistors M2 and M3 cut-off and generates the compensation waveform on the gate driving signal of the transistor M1 in a compensation interval, and so on. In this example, because two of the transistors M1-M3 are cut-off in each compensation interval, the data voltage of each pixel unit is kept unchanged. The image displayed by the display device does not blink, therefore.

In an example, the compensation waveform may be a square wave whose maximum voltage is a positive voltage. Based on different applications and designed concepts, the period and the maximum voltage of the square wave can be appropriately altered. For example, the period of the square wave may be smaller than the interval between the updating periods. Under such a condition, the gate driving signal of the second transistor switches to the maximum voltage of the square wave multiple times in single interval (e.g. the example shown in FIG. 3). Or, half of the period of the square wave (i.e. the period of being kept at the maximum voltage) may approximate the interval between the data updating periods. Under such a condition, the gate driving signal of the second transistor switches to the maximum voltage of the square wave once in single interval (e.g. the example shown in FIG. 4).

In an example, the driving device generates the compensation waveform on the second gate driving signal in one of a plurality contiguous intervals between every two data updating periods.

In an example, the driving device receives environment sensing signals (e.g. the light sensing signals LS and the temperature sensing signals TS) to determine whether to output compensation waveform. When the environment sensing signals indicate that the ambient environment conditions satisfy the compensation condition, the driving device generates the compensation waveform on the second gate driving signals.

Figure 7:
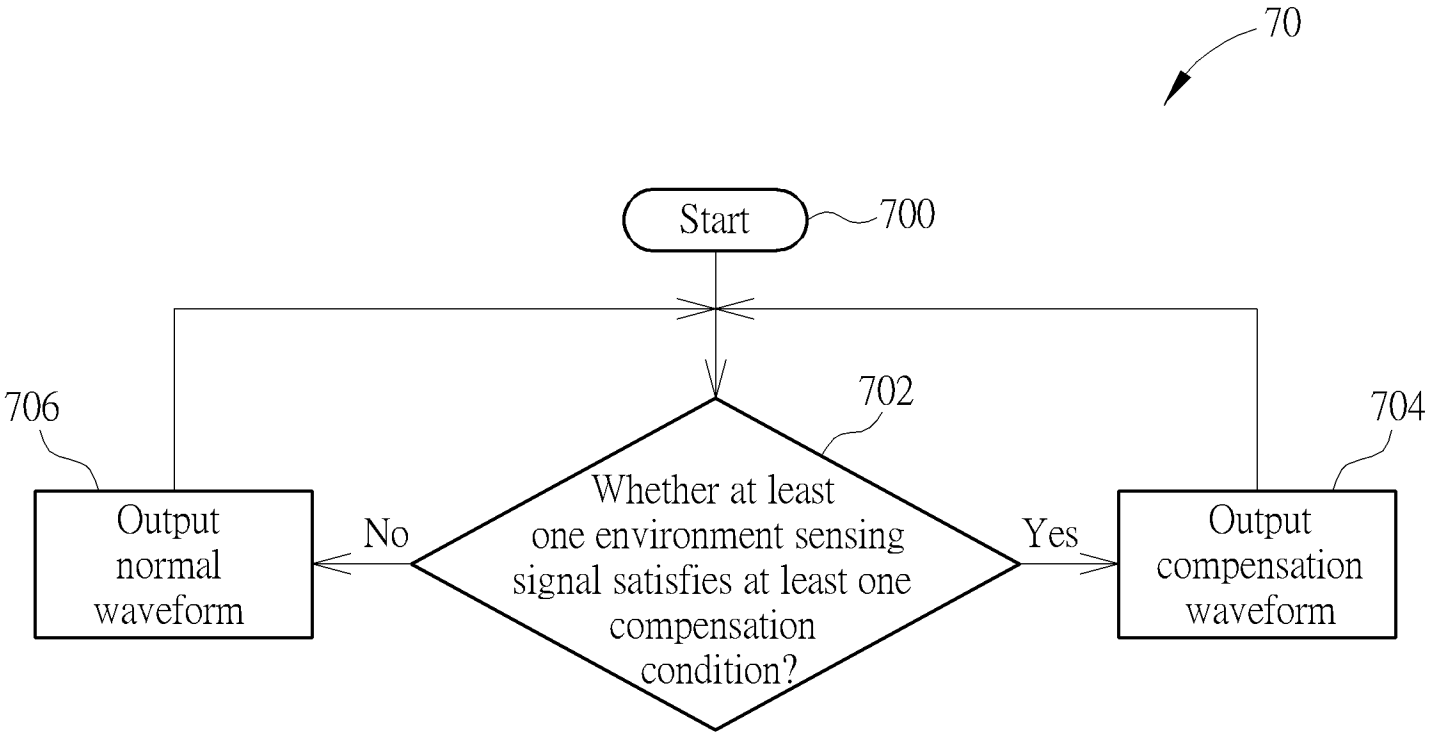
FIG. 7 is a flowchart of a process according to an example of the present invention.

The method of the computing unit 104 determining whether to adjust the gate driving signals according to the light sensing signal LS and the temperature sensing signal TS can be summarized into a process 70 shown in FIG. 7. The process 70 is utilized in a driving device of a display device for determining whether to generate a compensation waveform within intervals between every two contiguous data updating periods for preventing the threshold voltage of transistors in each pixel unit from shifting. The process 70 comprises the following steps:

Step 700: Start.

Step 702: Determine whether at least one environment sensing signal related to the ambient environment of the display device satisfies at least one compensation condition. If the at least one environment sensing signal related to the ambient environment of the display device satisfies the at least one compensation condition, perform step 704; otherwise, perform step 706.

Step 704: Output the compensation waveform.

Step 706: Output normal waveform.

According to the process 70, the driving device receive at least one environment sensing signal related to the ambient environment conditions of the display device, to determine whether the ambient environment conditions of the display device need to perform compensation. When the at least one environment sensing signal satisfies at least one compensation conditions, the driving device output a compensation waveform on the gate driving signal of one of a plurality transistors connected in series (e.g. the transistors MA and MB shown in FIG. 2) in each pixel unit within an interval between data updating periods. In an example, the compensation condition is light flux exceeding an illumination threshold or the ambient temperature is greater than a high temperature threshold. When the at least one environment sensing signal indicates that the light flux exceeding the illumination threshold or the ambient temperature is greater than the high temperature threshold, the driving device makes a first transistor of the plurality transistors cut-off and outputs the compensation waveform on the gate driving signal of at least one second transistor of the plurality of transistors, to reduce the threshold voltage shifting of the plurality of transistors. When determining the ambient environment conditions do not satisfy the compensation condition, the driving device outputs normal waveform to driving the display device. That is, the driving device does not output compensation waveform when the ambient environment condition does not satisfy the compensation condition, so as to reduce the power consumption.

In an example, the driving device performs the process 70 when the display device starts to operate (e.g. when the display device begins to display images), and stops performing the process 70 when the display device stops operating (e.g. when the display device is shut down).

The driving device of the present disclosure makes one of the transistors connected in series in each pixel unit cut-off and outputs the compensation waveform on the gate driving signal of at least one of remaining transistors within the intervals between every two data updating periods, to mitigate the threshold voltage shifting of the transistors. Further, the driving device detects the ambient environment conditions and outputs the compensation waveform when the ambient environment conditions satisfy certain compensation conditions. The power consumption is reduced, therefore.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A driving method for a display device with a plurality of pixels, wherein each pixel includes a plurality of transistors connected in series and the plurality of transistors connected in series of each pixel are controlled by at least two gate driving signals, the driving method comprising:

adjusting a first gate driving signal of a first transistor among the plurality of transistors to make the first transistor cut-off and generating compensation waveform on at least one second gate driving signal of at least one second transistor among the plurality of transistors within a compensation interval of a plurality of intervals between every two contiguous data updating periods among a plurality data updating periods, wherein a maximum voltage of the compensation waveform is able to conduct the at least one second transistor during the compensation interval;

wherein the plurality of transistors of each pixel are conducted in a specific period within the plurality of data updating periods, to update a data voltage of each pixel, wherein the data voltage remains unchanged during the compensation interval.

2. The driving method of claim 1, wherein the maximum voltage of the compensation waveform is greater than the minimum voltage of the display device.

3. The driving method of claim 1, wherein the compensation waveform is square wave.

4. The driving method of claim 3, wherein half of a period of the square wave is smaller than or equal to the compensation interval.

5. The driving method of claim 1, wherein the compensation interval is one of a plurality of contiguous intervals.

6. The driving method of claim 1, wherein the step of adjusting the first gate driving signal of the first transistor among the plurality of transistors to make the first transistor cut-off and generating the compensation waveform on the at least one second gate driving signal of the at least one second transistor among the plurality of transistors within the compensation interval of the plurality of intervals between every two contiguous data updating periods among the plurality data updating periods comprises:

determining whether at least one environment sensing signal of an ambient environment of the display device satisfies at least one compensation conditions; and adjusting the first gate driving signal of the first transistor among the plurality of transistors to make the first transistor cut-off and generating the compensation waveform on the at least one second gate driving signal of the at least one second transistor.

7. The driving method of claim 6, wherein the at least one environment sensing signal comprises at least one of a light sensing signal or a temperature signal.

8. A driving device, for a display device with a plurality of pixels, wherein each pixel comprises a plurality of transistors connected in series and the plurality of transistors connected in series of each pixel are controlled by at least two gate driving signals, the driving device comprising:

a driving circuit, for generating a plurality of gate driving signals controlling the plurality of transistors in each pixel according to a control signal; and a control circuit, for adjusting a first gate driving signal of a first transistor among the plurality of transistors to make the first transistor cut-off and generating compensation waveform on at least one second gate driving signal of at least one second transistor among the plurality of transistors within a compensation interval of a plurality of intervals between every two contiguous data updating periods among a plurality data updating periods, wherein a maximum voltage of the compensation waveform is able to conduct the at least one second transistor during the compensation interval;

wherein the plurality of transistors of each pixel are conducted in a specific period within the plurality data updating periods, to update a data voltage of each pixel, wherein the data voltage remains unchanged during the compensation interval.

9. A driving method for a display device with a plurality of pixels, wherein each pixel includes a plurality of transistors connected in series and the plurality of transistors connected in series of each pixel are controlled by at least two gate driving signals, the driving method comprising:

adjusting at least one first gate driving signal of at least one first transistor among the plurality of transistors to make the at least one first transistor cut-off and generating compensation waveform on at least one second gate driving signal of at least one second transistor among the plurality of transistors within a compensation interval of a plurality of intervals between every two contiguous data updating periods among a plurality data updating periods, wherein a maximum voltage of the compensation waveform is able to conduct the at least one second transistor during the compensation interval;

wherein the plurality of transistors of each pixel are conducted in a specific period within the plurality of data updating periods, to update a data voltage of each pixel, wherein the data voltage remains unchanged during the compensation interval.

10. A driving device, for a display device with a plurality of pixels, wherein each pixel comprises a plurality of transistors connected in series and the plurality of transistors connected in series of each pixel are controlled by at least two gate driving signals, the driving device comprising:

a driving circuit, for generating a plurality of gate driving signals controlling the plurality of transistors in each pixel according to a control signal; and a control circuit, for adjusting at least one first gate driving signal of at least one first transistor among the plurality of transistors to make the at least one first transistor cut-off and generating compensation waveform on at least one second gate driving signal of at least one second transistor among the plurality of transistors within a compensation interval of a plurality of intervals between every two contiguous data updating periods among a plurality data updating periods, wherein a maximum voltage of the compensation waveform is able to conduct the at least one second transistor during the compensation interval;

wherein the plurality of transistors of each pixel are conducted in a specific period within the plurality of data updating periods, to update a data voltage of each pixel, wherein the data voltage remains unchanged during the compensation interval.

* * * * *